US005341571A

United States Patent [19]

Prochaska

[11] Patent Number: 5,341,571

[45] Date of Patent: Aug. 30, 1994

[54] MOVABLE BLADE SHAVING CARTRIDGE OR THE LIKE

[75] Inventor: Frank H. Prochaska, Waynesboro, Va.

[73] Assignee: American Safety Razor Company, Verona, Va.

[21] Appl. No.: 46,989

[22] Filed: Apr. 16, 1993

[51] Int. Cl.[5] ..... B26B 21/22

[52] U.S. Cl. ..... 30/50; 30/47; 30/49

[58] Field of Search ..... 30/47–50, 30/346.5, 346.58, 346.59

[56] References Cited

U.S. PATENT DOCUMENTS

| | | | |
|---|---|---|---|
| Re. 30,913 | 4/1982 | Cartwright et al. | 30/47 |
| 4,069,580 | 1/1978 | Cartwright et al. | 30/47 |
| 4,168,571 | 9/1979 | Francis | 30/47 |
| 4,251,914 | 2/1981 | Grosjean | 30/32 |
| 4,270,268 | 6/1981 | Jacobson | 30/47 |
| 4,302,876 | 12/1981 | Emmett | 30/47 |
| 4,335,508 | 6/1982 | Francis et al. | 30/47 |
| 4,389,773 | 6/1983 | Nissen et al. | 30/50 |
| 4,403,412 | 9/1983 | Trotta | 30/47 |
| 4,443,939 | 4/1984 | Motta et al. | 30/49 |
| 4,443,940 | 4/1984 | Francis et al. | 30/50 |
| 4,459,744 | 7/1984 | Esnard | 30/49 |
| 4,461,079 | 7/1984 | Ciaffone et al. | 30/79 |
| 4,516,320 | 5/1985 | Peleckis | 30/49 |
| 4,574,476 | 3/1986 | Ortiz | 30/47 |
| 4,709,477 | 12/1987 | Ferraro | 30/50 |
| 4,720,917 | 1/1988 | Solow | 30/49 |
| 4,845,848 | 7/1989 | Strickland | 30/49 |
| 4,854,043 | 8/1989 | Chen | 30/50 |
| 4,893,641 | 1/1990 | Strickland | 132/200 |
| 4,942,662 | 7/1990 | Radcliffe | 30/49 |
| 4,964,214 | 10/1990 | Welsh et al. | 30/49 |
| 4,976,028 | 12/1990 | Chen | 30/49 |
| 4,993,154 | 2/1991 | Radcliffe | 30/85 |
| 5,003,694 | 4/1991 | Chen | 30/49 |
| 5,031,316 | 7/1991 | Oldroyd | 30/47 |
| 5,074,042 | 12/1991 | Althaus et al. | 30/50 |
| 5,185,927 | 2/1993 | Rivers | 30/50 |
| 5,199,173 | 4/1993 | Hegemann et al. | 30/49 |
| 5,205,040 | 4/1993 | Werner | 30/50 |
| 5,222,300 | 6/1993 | Althaus et al. | 30/50 |
| 5,224,267 | 7/1993 | Simms et al. | 30/50 |
| 5,251,376 | 10/1993 | Althaus et al. | 30/50 |
| 5,253,420 | 10/1993 | Althaus et al. | 30/50 |

FOREIGN PATENT DOCUMENTS

| | | |
|---|---|---|
| WO91/14546 | 10/1991 | PCT Int'l Appl. . |
| WO91/19596 | 12/1991 | PCT Int'l Appl. . |

*Primary Examiner*—Douglas D. Watts

*Attorney, Agent, or Firm*—Willian Brinks Hofer Gilson & Lione

[57] ABSTRACT a movable blade cartridge including a platform member having a blade seat and a guard member. The guard member is located of forward and parallel to the blade seat so as to form a longitudinal slot between the blade seat and the guard member. A primary blade which is disposed on the blade seat such that the cutting edge of the blade is located rearwardly of the guard member. A substantial portion of the primary blade extends into the slot formed between the guard member and the blade seat such that the blade is flexible into the slot. A spacer is located on the upper surface of the primary blade. The spacer comprises a rear portion which functions to separate the primary blade and a secondary blade, as well as a forward portion which extends from the rear portion and functions to prevent upward movement of the primary blade, and create an opening beneath the forward portion of the spacer and the lower surface of the secondary blade. Both the primary and secondary blade are manufactured and mounted so as to be flexible in response to forces encountered during the shaving operation. The blade cartridge also includes a cap member disposed on the secondary blade which prevents upward movement of the second blade.

15 Claims, 7 Drawing Sheets

2

MOVABLE BLADE SHAVING CARTRIDGE OR THE LIKE

BACKGROUND OF THE INVENTION

The present invention relates to wet shaving systems of the blade type and more particularly to a shaving system having a movable blade positioned within a blade cartridge or the like.

During the shaving process, shavers have long sought a wet shaving system which provides a smooth and comfortable shave without having annoying cuts and abrasions caused by the blade being at the wrong blade exposure or shaving angle in response to shaving forces.

The terms "blade exposure" and "shaving angle" represent geometrical relationships between the blade and the shaving surface. These terms as well as another term commonly used in the art are defined as follows. First, the term "shaving plane" means the plane tangent to skin engaging surfaces, referred to as a guard and a cap, which are disposed on both sides of the blade so as to engage the shaving surface before and after engagement by the blade. Second, the term "blade exposure" means the distance by which the blade edge projects forwardly of the shaving plane. Third, the term "shaving angle" means the acute angle between a plane tangent to the cutting edge of the blade and the shaving plane.

Various approaches have been used to enable the shaving blade to move relative to the blade cartridge or razor body in response to shaving forces encountered during the shaving process in an effort to present the correct blade exposure and shaving angle.

One approach disclosed in prior art patents illustrates a blade cartridge comprising two blades separated by a spacer with the blades and the spacer attached to a cap to form a unitary assembly. The blade assembly is movable between various blade exposures and shaving angles within various degrees of control and direction in response to forces encountered during shaving. For example, Ciaffone et al., U.S. Pat. No. 4,461,079, discloses a razor cartridge comprising a body portion 10 which includes a guard bar 12 (FIGS. 1–5). The guard bar 12 defines a leading skin-engaging surface fixed to the body portion. A rear beam 17 spans end walls 14 and 16 of the body portion 10 and a medial support member 13 to join the front of the cartridge 12 to the end thereof. A plurality of generally flat coplanar segments 18,19,21,22, each having an opening 23, are hinged to the rear beam 17 by mating webs 24,26,27,28 (col. 2, lines 50–52). Collectively, the segments 18,19,21,22 define a blade seat which is operable to pivot about the beam 17, thereby changing the attitude of blade edge relative to guard bar 12 (col. 2, lines 53–57). A cap 33 is apparently placed above an assembly of two skin-engaging blades 34,36, straddling a spacer 37 (FIG. 3). The two blades and the spacer are secured to one coplanar segment 21 of the blade support or blade seat by a conventional rivet 38 to form a rigid unit. A hinge 27 connects the coplanar segment 21 to the rear-beam 17 (col. 3, lines 1–8). As compared to the position of the blade edges relative to the guard bar at the normal or free position set in accordance with a predetermined blade geometry (FIG. 3), a change in blade geometry occurs during the course of shaving when a shaving force F causes the blade package to rotate or pivot about rear-beam 17 in the direction of arrow R where the blade edges are rendered less "aggressive" (FIG. 4, col. 3, lines 13–23). Upon relaxation of shaving forces, the elastic memory of hinges 24,26,27,28 forces the blade seat, and therefore the blade edges, to return to their normal position (FIG. 3., col. 3, lines 24–26).

In an alternative embodiment, Ciaffone et al. shows the blade seat is hinged to a front beam 175 by webs 240,260,270,280 (FIGS. 6–10, col. 3, lines 46–48). Upon exertion of a shaving force F′ (FIG. 9) onto the cap 330, the coplanar segments 180,190,210 and 220, move in the direction of the arrow R (FIG. 9) to provide a more aggressive edge exposure (col. 4, lines 1–9). As in the embodiment of FIGS. 1–5, the elastic memory of the hinges 240,260,270,280 forces the blade edges to return to the free position when shaving forces are released (col. 4, lines 11–13).

Oldroyd et al., U.S. Pat. No. 4,063,354, discloses a shaving unit wherein a blade unit comprises two blades separated by a spacer 5 (FIGS. 13–16). A resiliently flexible metallic or plastic guard 3 is secured to the blade unit by spot welding or other means (col. 3, lines 26–28). The blade unit, which is illustrated in its normal forward position of maximum blade exposure in FIG. 13, can bow rearwardly under pressure applied during shaving to carry the blade unit along a plane to the rear, relative to the platform 1 and cap 4. This reduces blade exposure but increases the shaving angle, as indicated by dotted lines 3′ in FIGS. 13 and 15 (col. 3, lines 26–37).

Althauset et al., U.S. Pat. No. 5,074,042, discloses a shaver head comprising two staggered blades 7 embedded in a blade block 6 (FIG. 3). A cover cap portion 9 covers the top side of the blade block 6 (col. 3, lines 12–15). A spring 14 is placed between the blade block 6 and a body 2. The blade block 6, together with the two staggered blades 7, can swivel about an axis A (col. 3, lines 17–43). During shaving, pressure is applied to the razor blade unit, thereby causing the blade block 6 to swivel and alter shaving geometry of the blades (col. 3, lines 46–60).

Jacobson U.S. Pat. Nos. 4,442,598, 4,378,634 and 4,270,268 disclose a razor blade assembly including a body member 2 having blade means 36,36′ being independently movable in response to spring finger biasing means 18,18′ integral with the body member. In the Jacobson patents, the spring fingers 18,18′ move the blade means 36,36′ along planes defined by slots 16 in end portions 4,6 of the body member 2.

In all of the aforementioned patents, the blade members either engage movable spring fingers formed integral with the blade cartridge, or are mounted permanently to a platform which is movably connected to the blade cartridge. These methods of providing a movable blade necessitate an elaborate and expensive molding procedure to create a blade cartridge having either integral spring fingers or a movable blade platform. While it has been noted that blades movable relative to the shaving surface during the shaving process are advantageous, it is desirable to eliminate the need for the elaborate molding process required by the movable blade assemblies of the prior art.

SUMMARY OF THE INVENTION

The present invention provides a novel blade cartridge designed to satisfy the aforementioned needs. The invention embodies a plurality of blade members permanently fixed relative to the blade cartridge. Unlike the movable blade assemblies of the prior art, there are no movable support members in the blade cartridge of the present invention. Each blade is mounted such that a substantial portion of the blade is free from contact with support members. The free end of each blade functions as a single cantilever forming a "flexing zone" about which the cutting edge of the blade bends in response to an applied force. Each blade is flexible about the longitudinal axis of the blade. Thus, the present invention provides for individually movable blades without requiring an elaborate molding procedure to create movable spring fingers or movable blade platforms.

Accordingly, the present invention relates to a blade cartridge comprising a platform member having a blade seat and a guard member. The guard member is located forward of and parallel to the blade seat so as to form a longitudinal slot between the blade seat and the guard member. The blade cartridge also comprises a primary blade which is disposed on the blade seat such that the cutting edge of the blade is located rearwardly of the guard member. A substantial portion of the primary blade extends into the slot formed between the guard member and the blade seat such that the blade is flexible about the longitudinal axis of the blade into the slot. Preferably, the cutting edge of the primary blade is parallel to the guard member.

The blade cartridge also comprises a spacer which is located on the upper surface of the primary blade. The spacer comprises a rear portion which functions to separate the primary blade and a secondary blade. The spacer also comprises a forward portion which extends from the rear portion and functions to prevent upward movement of the primary blade, and to create an opening beneath the forward portion of the lower surface of the secondary blade.

The blade cartridge also comprises a cap member disposed on the secondary blade. The cap member comprises fastening means to secure the members forming the blade cartridge together, and a member which prevents upward movement of the secondary blade.

As described hereinafter, each blade is independently movable in response to shaving forces applied to the blade. Specifically, each blade is flexible about the longitudinal axis of the blade within a flexing zone defined by the ratio between the portion of the blade overlying a physical structure and the portion of the blade overlying the opening formed beneath the forward portion of each blade, in combination with the physical characteristics of the blade. If a force exceeding the resilient force of the blade is exerted on the blade, the blade flexes about the longitudinal axis so as to bend in the downward direction against the resilient force of the blade. The bending movement of the blade results in the simultaneously decrease of blade exposure and shaving angle.

Preferably, the blade cartridge is connected to a handle, and can be pivotally connected so as to allow the blade cartridge to further respond to shaving forces encountered during the shaving process.

The invention itself, together with further objects and advantages, will best be understood by reference to the following detailed description taken in conjunction with the accompanying drawings.

DETAILED DESCRIPTION OF THE INVENTION

Figure 4:
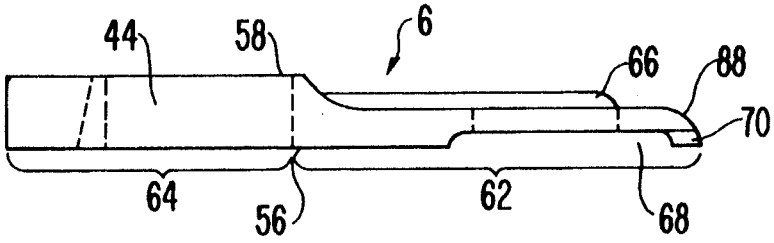
FIG. 4 illustrates an end view of the spacer shown in FIG. 3.

Turning now to the drawings, FIGS. 1–10 illustrate a movable blade shaving cartridge ("MBSC" or blade cartridge) or razor head 10 which comprises a platform member 2, flexible blade means 32, 34, a spacer 6 and a cap member 8.

Figure 2:
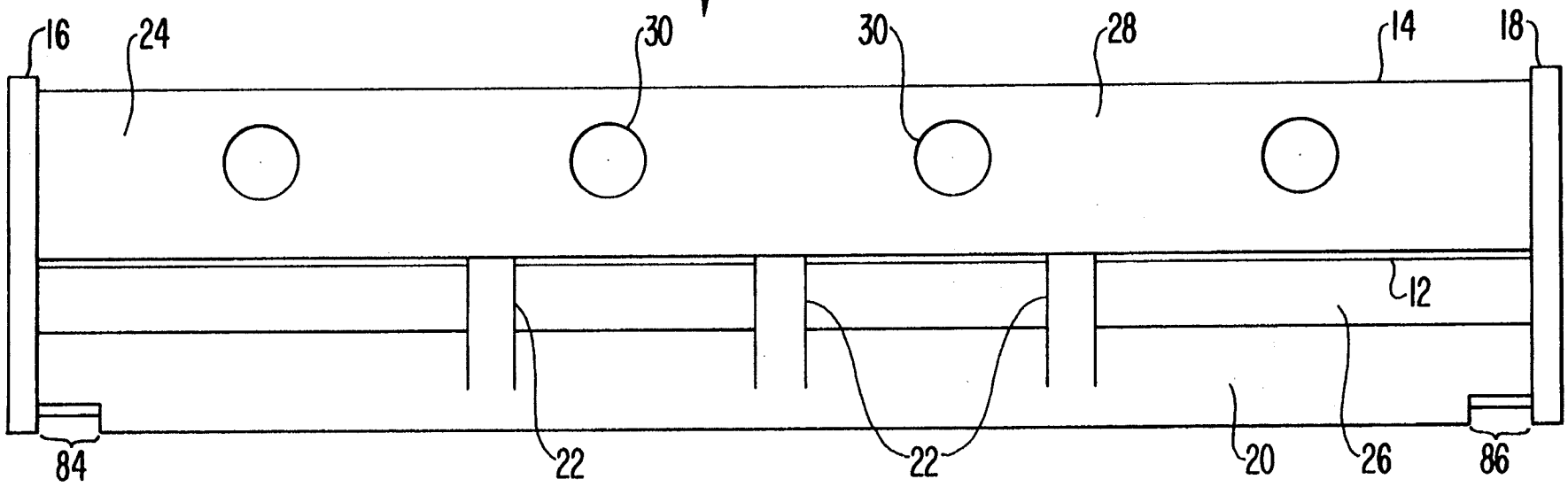
FIG. 2 illustrates a top plan view of the platform member of the present invention showing the blade seat, the guard member and a plurality of support members integrally molded to the blade seat and guard member.

As shown in FIG. 2, the platform member 2 comprises a blade seat 24 having a front and rear wall 12,14, and ends 16,18. The ends 16,18 extend beyond the front wall 12 so as to allow a guard member 20 to be interconnected between the ends 16,18 at a position forward of the front wall 12. The guard member 20 extends parallel to the front wall 12 forming a slot 26 between the guard member 20 and the front wall 12. The guard member 20 also is connected to the front wall 12 by a plurality of support members 22, which extend substantially perpendicular to the longitudinal axis of the both the guard member 20 and the front wall 12.

The blade seat 24 further comprises an upper surface 28, as well as a plurality of securing apertures 30. The securing apertures operate in conjunction with fastening means 80 located on the cap member 8, such as rivets, to permanently secure the platform member 2, the flexible blade means, the spacer 6 and the cap member 8 together.

The flexible blade means comprises a primary and secondary blade 32,34, each having substantially parallel front and rear edges with the front edge of each blade defining a cutting edge 36,38. Each blade 32,34 defines a longitudinal axis which is parallel to the cutting edge of the blade 32,34, and a lateral axis which is perpendicular to the cutting edge of the blade 32,34. Each blade 32,34 is flexible about its longitudinal axis.

Figure 8:
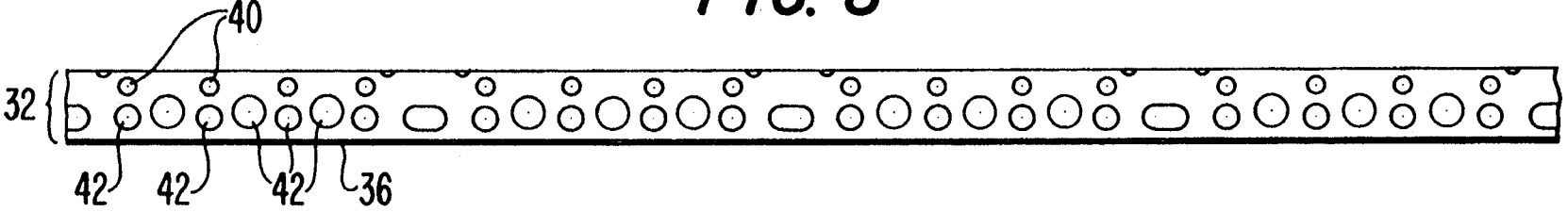
FIG. 8 illustrates a blade used for the primary blade structure.

As shown in FIG. 8, the primary blade 32 comprises securing apertures 40 which align with the securing apertures 30 of the blade seat 24 so as to allow the fastening means 80 to pass through the securing apertures 40 of the primary blade 32, thereby securing the primary blade 32 to the blade cartridge 10.

Figure 9:
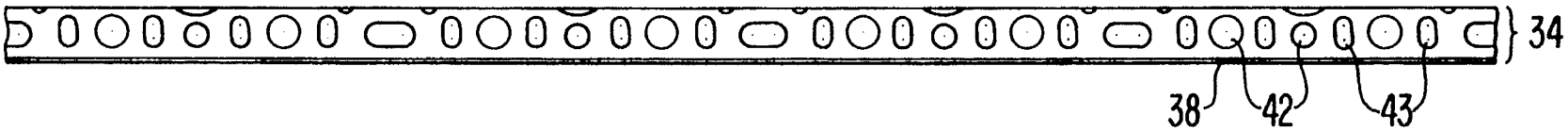
FIG. 9 illustrates a blade used for the secondary blade structure.

The secondary blade 34 is illustrated in FIG. 9. Similar to the primary blade 32, the secondary blade 34 comprises securing apertures 43 which align with the securing apertures 30 of the blade seat 24 so as to allow the fastening means 80 to pass through the securing apertures 43 of the secondary blade 34, thereby securing the blade to the blade cartridge 10. However, the securing apertures 43 of the secondary blade 34 preferably are oval in shape and perform a dual function. The first function, which has already been stated, is to secure the secondary blade 34 to the blade cartridge 10. The second function of the apertures 43 is to contribute to the flexibility of the secondary blade 34. The secondary blade 34 is positioned such that the fastening means 80 passes through the rear portion of each securing aperture 43 (i.e. the portion farthest away from the cutting edge 38). As a result, the portion of the aperture 43 free from contact with the fastening means 80 contributes to the flexibility of the secondary blade 34.

Furthermore, both the primary and secondary blades 32,34 comprise a plurality of holes 42 located proximate the cutting edge 36,38 of the respective blade 32,34. The holes 42 provide a passage to facilitate the removal of shaving debris and contribute to the flexibility of the blades 32,34. Specifically, the diameter of the holes 42 in combination with the thickness of the blades 32,34 partially determines the degree of flexibility of the blades 32,34. Preferably, the sum of the longitudinal dimensions of the holes 42 on the primary blade 32 should be between 35 to 75 percent of the length of the blade. Similarly, the sum of the longitudinal dimensions of the apertures 43 and holes 42 on the secondary blade 34 should be between 35 to 75 percent of the length of the blade.

Figure 1:
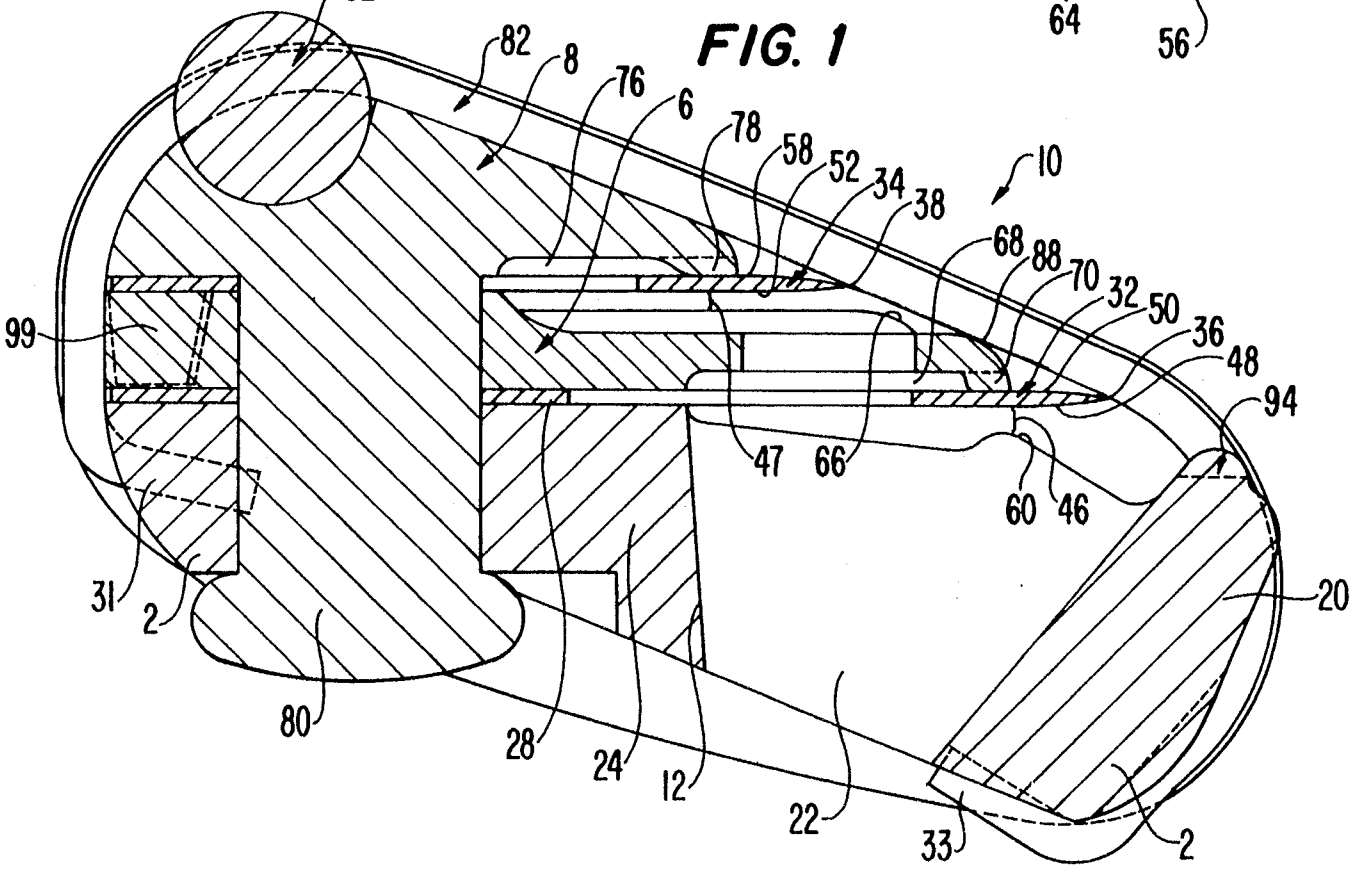
FIG. 1 is a cross-sectional view of the blade cartridge of the present invention through a rivet on the cap member illustrating the complete assembly.

As shown in FIGS. 1 and 2, the support members 22 extend downwardly away from the upper surface 28 of the blade seat 24 so as to create a gap 46 between the lower surface 48 of the primary blade 32 and the upper surface of each support member 22. Preferably, each support member 22 also comprises a lip 60 which operates as a stop to prevent further downward movement of the primary blade 32.

The spacer or "soap bar" 6, which is placed between the primary and secondary blades 32,34, functions to separate the blades 32,34. As shown in FIGS. 1 and 4, the spacer 6 comprises an upper and lower surface 58,56 and is divided into a forward portion 62 and a rear portion 64. The rear portion 64 of the spacer 6 exhibits a uniform height (i.e. the distance between the blades 32,34 measured perpendicularly to the longitudinal axis of the blades), so that when the blades 32,34 are secured to the upper and lower surface 58,56 of the spacer 6, respectively, the blades 32,34 are parallel to one another.

Preferably, as shown in FIG. 1, the primary blade 32 and the secondary blade 34 are separated from each other by a distance of about 0.20 inches to about 0.035 inches by the spacer 6. The height of the rear portion 64 of spacer 6 defines the separation between the two blades 32,34.

The forward portion 62 of the spacer 6 comprises portions having a reduced height relative to the rear portion 64 so as create areas where the blades 32,34 do not contact the spacer 6. Specifically, as shown in FIGS. 1 and 4, the upper surface 58 of the forward portion 62 exhibits an arcuate downward slope proximate the rear portion 64 and thereafter extends in the direction parallel to the plane of the blade 34. Furthermore, a plurality of ribs 66 are disposed on the upper surface 58 of the forward portion 62 of the spacer 6. The ribs 66 extend perpendicularly to the longitudinal axis of the blades 32,34 and exhibit a height such that the top of ribs 66 are below the plane of the upper surface 58 of the rear portion 64 of the spacer 6.

Figure 3:
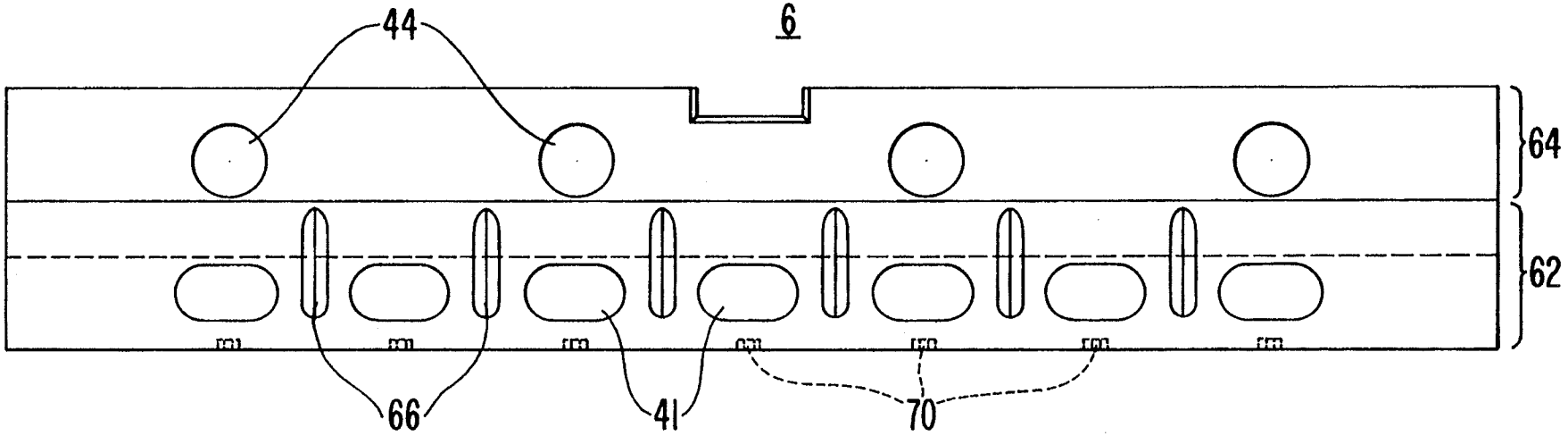
FIG. 3 illustrates a top plan view of a first embodiment of the spacer of the present invention.

The lower surface 56 of the forward portion 62 of the spacer 6 forms a cavity 68, which extends in a direction parallel to the cutting edge 36,38 of the blades 32,34. The lower surface 56 of the forward portion 62 of the spacer 6 further comprises a plurality of downwardly extending pads 70 on the outer edge of the forward portion 62 of the spacer 6. As shown in FIG. 3, the pads 70 are separated from one another so as to allow water to flow through the front of the spacer 6 into the cavity 68. Referring to FIG. 1, it is apparent that the primary blade 32 extends beyond the downwardly extending pads 70 of the spacer 6. As a result, the pads 70 operate as a stop limiting the upward movement of the primary blade 32.

Furthermore, similar to both blades 32,34, the spacer 6 comprises four securing apertures 44 which are located on the rear portion 64 of the spacer 6. The securing apertures 44 operate in conjunction with the fastening means 80 to secure the spacer 6 to the blade cartridge 10. The spacer 6 also comprises a plurality of holes 41 located on the forward portion 62 of the spacer 6, which align with the holes 42 of both the primary and secondary blades 32,34. The alignment of the spacer holes 41 and blade holes 42 allows water to be directed to the edges of both blades 32,34 so as to facilitate the removal of shaving debris.

Figure 5:
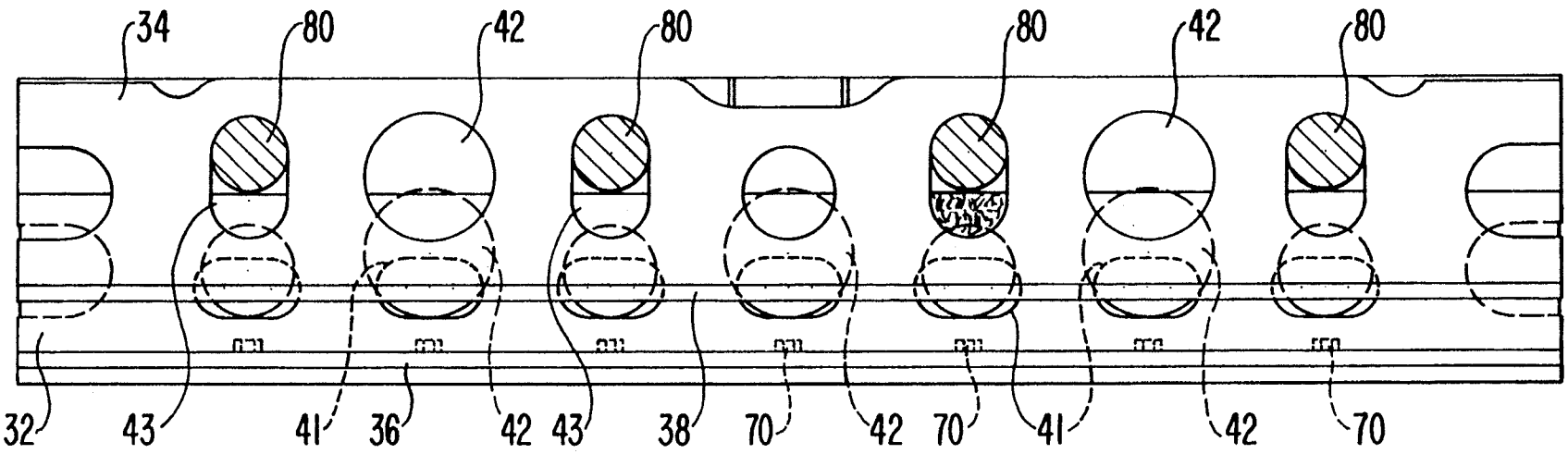
FIG. 5 illustrates a top plan view of the primary and secondary blade, and the spacer in the assembled position.

FIG. 5 illustrates the alignment of the primary and secondary blades 32,34 and the spacer 6. As shown the cutting edge 36 of the primary blade 32 is located forward of the cutting edge 38 of the secondary blade 34. The holes 42 in the blades 32,34 and the holes 41 in the spacer 6 align such that the water can flow from the lower surface 48 of the primary blade 32 to the upper surface 54 of the secondary blade 34. The water passage facilities the removal of shaving debris from the cutting edges 36,38 of the blades 32,34.

Figure 7:
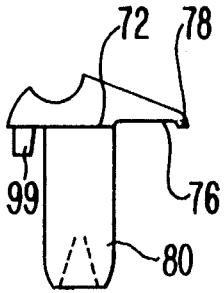
FIG. 7 illustrates an end view of the cap member shown in FIG. 6.

The cap member 8 is disposed on the upper surface 54 of the secondary blade 34. As shown in FIG. 1 and 7, similar to the spacer 6, the lower surface 72 of the cap member 8 forms a cavity 76 which extends parallel to the cutting edge 36,38 of the blades 32,34. Also, the lower surface 72 of the cap member 8 comprises a plurality of downwardly extending pads 78 on the forward portion of the cap member 8. Again, similar to the spacer 6, the pads 78 are separated from one another so as to allow water to flow through the front of the cap member 8 into the cavity 76. As shown in FIG. 1, the secondary blade 34 extends beyond the downwardly extending pads 78 of the cap member 8, and therefore the pads 78 operate as a stop limiting the upward movement of the secondary blade 34.

In addition, the cap member 8 comprises a plurality of fastening means 80, such as rivets. The fastening means 80 extend downwardly from the lower surface 72 of the cap member 8 and pass through the securing apertures 44 of the spacer 6 and the securing apertures 40,43 of the blades 32,34 and into the securing apertures 30 of the blade seat 24. The ends of the fastening means 80 extend beyond the blade seat 24 and are upset thereby permanently affixing the blade seat 24, blades 32,34, spacer 6 and cap member 8 together.

FIG. 1 illustrates in detail the novel structure of the blade cartridge 10 of the present invention. As is apparent, the primary blade 32 is disposed on the upper surface 28 of the blade seat 24 with the cutting edge 36 extending over the slot 26 between the guard member 20 and the front wall 12 of the blade seat 24. The width of the blade seat 24 (i.e. distance between the front and rear wall 12,14) and the width of the primary blade 32 is such that a substantial portion of the primary blade 32 extends over the slot 26.

The spacer 6 is disposed on the upper surface 50 of the primary blade 32. As shown in FIG. 1, one edge of the cavity 68 generally aligns with the front wall 12 of the blade seat 24 so as to form a vertical plane, thereby partially defining a flexing zone for the primary blade 32. The application of force upon the primary blade 32 causes the primary blade 32 to flex about the longitudinal axis in a downwardly direction. The downward movement of the primary blade 32 stops when the blade 32 engages the lips 60 formed on the support members 22. Thus, the distance the blade 32 is allowed to flex is defined by the height of the lip 60 relative to the upper surface 28 of the blade seat 24. The resiliency of the primary blade 32 returns the blade to the normal, horizontal position (as shown in FIG. 1) upon removal of the applied shaving force.

The secondary blade 34 is disposed on the upper surface 58 of the spacer 6 with the cutting edge extending over the opening 47 created between the forward portion 62 of the spacer 6 and the lower surface 52 of the secondary blade 34. Similar to the primary blade 32, the width of the rear portion 64 of the spacer 6 is such that a substantial portion of the secondary blade 34 extends over the opening 47.

The cap member 8 is disposed on the upper surface 54 of the secondary blade 34 such that one edge of the cavity 76 formed on the lower surface 72 of the cap member 8 generally aligns with beginning of the forward portion 62 of the spacer 6 so as to form a vertical plane. As shown in FIG. 1, the edge of the cavity 76 in conjunction with the sloping surface of the forward portion 62 of the spacer 6 partially defines the flexing zone for the secondary blade 34. As with the primary blade 32, the application of a force on the secondary blade 34 causes the blade 34 to flex about the longitudinal axis in the downwardly direction. The downward movement of the secondary blade 34 stops when the blade engages the ribs 66 formed on the upper surface 58 of the spacer 6. The resiliency of the secondary blade 34 returns the blade to the normal, horizontal position upon removal of the applied force.

As previously stated, the downwardly extending pads 70,78 of the spacer 6 and the cap member 8 prevent movement of the primary and secondary blades 32,34, respectively, in the upward direction beyond the horizontal position. It will be appreciated that as the portion of the primary and secondary blade 32,34 extending over the slot and opening 26,47, respectively, is reduced (i.e. as the flexing zone moves closer to the cutting edge), the flexibility of the blade will also be reduced. The flexibility of each blade depends upon factors including (1) the location of the flexing zone, (2) the thickness of the blade, and (3) the dimensions of the holes 42 in the blades (apertures 43 also contribute to the flexibility of the secondary blade). These factors can be adjusted so that the blades 32,34 flex when the applied force exceeds a predetermined level.

In order to prevent the corners of the blades 32,34 from engaging the skin of the user, end clips 82 cover the outer edges of the primary and secondary blades 32,34. As shown in FIG. 1, each end clip 82 comprises a thin strip of material having a leg 31,33 on each end and is generally in a "C" shape. Each end clip wraps around the blade cartridge 10, whereby the legs 31,33 of each end clip are secured to the bottom of blade cartridge 10. Referring to FIG. 2, one end clip 82 is disposed in a slot 84 adjacent end 16. A second end clip 82 is disposed in a slot 86 adjacent end 18. Each end clip 18 runs perpendicular to the longitudinal axis of the blades 32,34 and covers the outer edges of the blades 32,34.

As a result of mounting the blades 32,34 in accordance with the present invention, there is no longitudinal movement of either the primary or secondary blade 32,34 relative to the remainder of the blade cartridge 10. Only rotational movement about the flexing zone associated with the each blade 32,34 is possible. More specifically, each blade 32,34 can only bend about the longitudinal axis of the blade within the flexing zone in a direction which reduces the blade exposure and shaving angle of the blade relative to a shaving surface. Furthermore, the primary and secondary blades 32,34 flex independently of one another.

For example, if the pressure encountered by the primary blade 32 exceeds the resilient force of the primary blade 32, the primary blade 32 bends in response to that force. Specifically, the primary blade 32 bends about the flexing zone, thereby causing the cutting edge 36 to move in a downward manner. Upon removal of the force, the primary blade 32 would return to the horizontal position as shown in FIG. 1. If an equivalent force were applied to the secondary blade 34, it would respond in a similar manner. Thus, the cutting edges 36,38 of the blades 32,34 move downwardly away from the shaving plane and adjust to a lower, safer shaving angle and blade exposure.

As illustrated in FIGS. 1 and 2, the guard member 20 placed in front of the primary blade 32 is integral with the ends 16,18 of the platform member 2 and is therefore stationary relative to the blade cartridge 10. Similar to the guard 20 being positioned in front of the primary blade 32, as shown in FIG. 5, the spacer 6 has a raised oval or round skin engaging portion 88, which provides an engaging surface to control exposure of the secondary blade 34 to the shaver's skin.

Variations on the embodiments described above are possible. In a first variation, the height of the lips 60 formed of the support members 22 may be varied so as to effect different bending patterns. For example, if the lips 60 on the support members 22 in the center of the platform member 2 are lower relative to the lips 60 on the support members located proximate the ends of the platform member 2, the primary blade 32 exhibit increases movement in the center of the blade. With regard to the secondary blade, the same changes can be effected by varying the height of the ribs 66 located on the upper surface 58 of the spacer 6.

Furthermore, numerous variations of the flexible blades 32,34 are possible. For example, each blade 32,34 may be tapered such that the thickness of the blade decreases in the direction of the forward portion of the blade. Also, each blade 32,34 can comprise a U-shaped channel in the forward portion of the blades, which functions to define the flexing zone for the blade 32,34. Finally, the additional holes can be added to the blades of the preferred embodiment to vary the flexibility of the blades 32,34.

In another variation, the blade means comprises a single blade positioned between the platform member 2 and the cap member 8. The operation and movement of the single blade is the same as either blade in the two blade embodiment. However, the forward portion of the cap member would be extended relative to the cap member of the two blade embodiment such that the single blade razor exhibits the correct shaving geometry.

Figure 6:
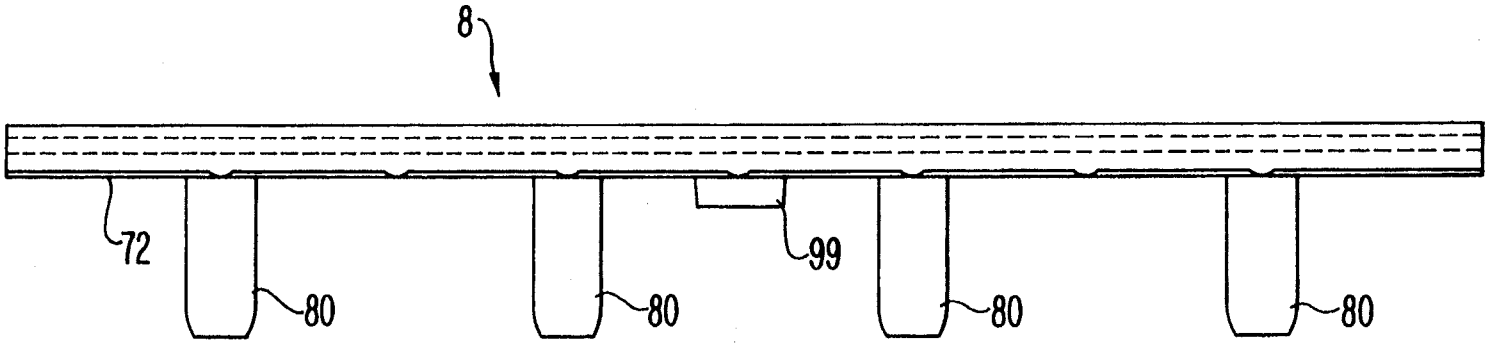
FIG. 6 illustrates a front view of a first embodiment of the cap member of the present invention.

In another variation, as shown in FIG. 6 and 7, the cap member 8 further comprises a downwardly extending guide member 99 which functions to locate the secondary blade 34 in the desired position prior to permanently securing the cap member 8 to the platform member 2.

In another variation, the guard member 20 may include means to allow independent movement of the guard member 20 in the direction away from the direction of shaving forces acting upon the guard member 20. Jacobson U.S. Pat. Nos. 4,442,598, 4,378,634 and 4,270,268 disclose a blade cartridge having movable guard means.

Similarly, the cap member 8 may include means to allow independent movement in a direction away from the direction of shaving forces acting upon said cap member 8. Oldroyd et al., U.S. Pat. No. 4,063,354, discloses a shaving unit having a movable cap member 8 suitable for use with this invention.

In yet another variation, a shaving aid 90 may be affixed or included with the blade cartridge 10. Typically, as shown in FIG. 1, the shaving aid 90 comprises a polystyrene-polyethylene ! oxide blend in the form of lubricating cylinder 92, which may affixed to the upper surface 74 of the cap member 8 behind the secondary blade 34. During shaving, the polyethylene oxide bleaches out of the styrene matrix. Other suitable shaving aids for use with the invention are also described in U.S. Pat. No. 4,170,821 issued to Booth entitled "Razor Cartridges." Preferably, the shaving aid 90 comprises a matrix of polystyrene, polyethylene oxide and aloe and/or vitamin E. Also, the shaving aid 90 may define a lubrication strip 94, shown by dotted lines in FIG. 1, positioned near the guard member 20, either separately or in combination with the lubrication cylinder 92 located on the cap member 8.

In yet a further variation, the blade cartridge 10 may be permanently or detachably connected to a handle by suitable structures formed on the bottom surface of the blade cartridge 10. For example, the bottom surface of the blade cartridge 10 can be formed so as to attach to a handle in the manner described in U.S. Pat. No. 4,883,779 entitled PLATFORM, HANDLE AND SHIELD FOR SAFETY RAZOR, which issued to C. Iten and is hereby incorporated by reference.

Figure 10:
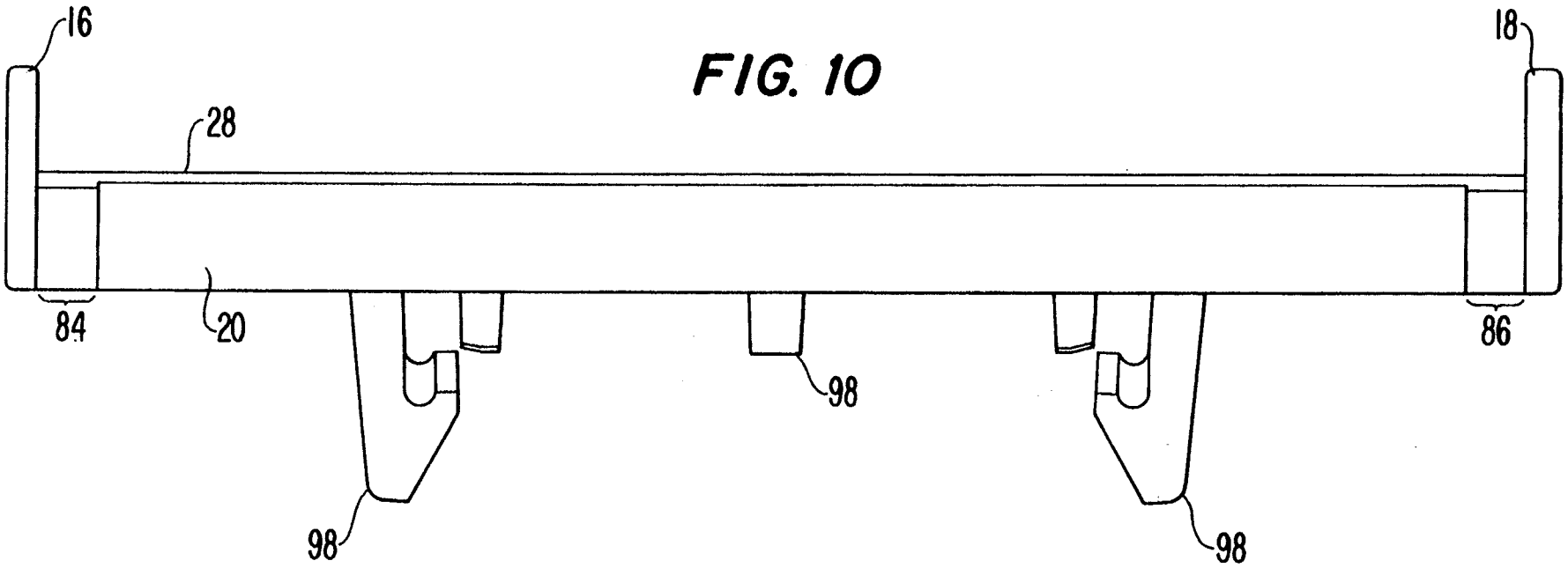
FIG. 10 illustrates one embodiment of the platform member adapted to receive a razor handle so as to pivotally connect the blade cartridge to the razor handle.

Alternatively, the blade cartridge 10 can be mounted on a handle in such a manner that it pivots or is stationary while it is used to shave a surface. For example, as illustrated in FIG. 10, the bottom surface of the platform member 2 comprises mounting members 98 which allow the blade cartridge 10 to be pivotally mounted to a handle.

Still further, it is within the spirit of this invention to detachably connect the blade cartridge 10 to a handle, such as in U.S. Pat. No. 4,026,016 entitled RAZOR BLADE ASSEMBLY, issued to Warren I. Nissen, which is incorporated herein by reference.

In another variation, the upper and lower surfaces 58,56 of the rear portion 64 of the spacer 6 comprises a plurality of channels so as to allow shaving debris to be led out the back of the blade cartridge 10. Conversely, water can be directed into the back of the blade cartridge 10 to be channeled out through the front of the blade cartridge 10 and the edges 36,38 of the blades 32,34.

In another variation, the downwardly extending pads 70,78 located on the spacer 6 and the cap member 8 are replaced by a single downwardly extending pad which is parallel to the cutting edges of the blades and has a length at least equal to the length of the blades.

The embodiments described above provide a number of significant advantages. The use of a blade which is flexible about the longitudinal axis of the blade within a body portion of a blade cartridge or the like precisely controls blade geometry in response to shaving forces. Any flexing of the blade results in the simultaneous reduction of both critical safety dimensions, blade exposure and shaving angle.

As yet another advantage, the blade cartridge of the present invention, simplifies the manufacturing process for creating blade cartridges. The present invention eliminates the need for creating an injection mold comprising a plurality of thin, individual spring fingers or leaf springs or the like.

Of course, it should be understood that a wide range of changes and modifications can be made to the preferred embodiment described above. It is therefore intended that the foregoing detailed description be understood that it is the following claims, including all equivalents, which are intended to define the scope of this invention.

What is claimed is:

1. A flexible blade cartridge comprising:

a platform member having a blade seat and a guard member, said blade seat having an upper surface, said guard member disposed forward of said blade seat so as to form a slot between said blade seat and said guard member;

a first blade having an upper and lower surface and a cutting edge, said first blade disposed on said upper surface of said blade seat such that said cutting edge is located rearwardly of said guard member, said first blade being flexible into said slot, said first blade being flexible about the longitudinal axis of said first blade;

a spacer disposed on said first blade having an upper and lower surface, and a member which engages the upper surface of said first blade so as to prevent upward movement of said first blade;

a second blade having an upper and lower surface disposed on the upper surface of said spacer having a cutting edge located rearwardly of said cutting edge of said first blade; said lower surface of said second blade forming a gap with said upper surface of said spacer; said second blade being flexible into said gap, said second blade being flexible about the longitudinal axis of said second blade; and a cap member disposed on said upper surface of said second blade having a member which engages the upper surface of the second blade so as to prevent upward movement of said second blade; and fastening means for securing said first and second blade, said spacer, said platform member and said cap in position.

2. A flexible blade cartridge according to claim 1, wherein said platform member further comprises a plurality of support members between said blade seat and said guard member, said support members extending downwardly from said upper surface of said blade seat so as to create a gap between said upper surface of said support members and said lower surface of said first blade.

3. A flexible blade cartridge according to claim 2, wherein said support members comprise lips disposed on said upper surface of said support members, said lips limit the movement of said primary blade in the downward direction.

4. A flexible blade cartridge according to claim 1, wherein said spacer further comprises a forward and a rear portion, said rear portion having a uniform height, said forward portion extending downwardly from said upper surface of said rear portion so as to create an opening between said upper surface of said forward portion of said spacer and said lower surface of said second blade.

5. A flexible blade cartridge according to claim 4, wherein said upper surface of said forward portion of said spacer further comprises ribs disposed on said upper surface, said ribs limit the movement of said secondary blade in the downward direction.

6. A flexible blade cartridge according to claim 4, wherein said forward portion of said spacer comprises a cavity on said lower surface which forms an opening between said upper surface of said first blade and said lower surface of said spacer.

7. A flexible blade cartridge according to claim 6, wherein said spacer comprises a plurality of downwardly extending pads, said pads engage said upper surface of said first blade so as to limit upward movement of the blade.

8. A flexible blade cartridge according to claim 1, wherein said cap member comprises a lower surface having a cavity which forms an opening between said upper surface of said second blade and said lower surface of said cap member.

9. A flexible blade cartridge according to claim 8, wherein said cap member comprises a plurality of downwardly extending pads, said pads engage said upper surface of said second blade so as to limit upward movement of the blade.

10. A flexible blade cartridge according to claim 1, wherein said first and second blade members and said spacer comprise a plurality of holes which align with one another so as to allow for the removal of shaving debris.

11. A flexible blade cartridge according to claim 1, further comprising lubrication means located proximate said cap member, said lubrication means comprising a matrix of polystyrene, and polyethylene.

12. A flexible blade cartridge according to claim 6, wherein an edge of said cavity on the lower surface of said spacer aligns with said upper surface of said blade seat so as to define a flexing zone for said first blade.

13. A flexible blade cartridge according to claim 8, wherein an edge of said cavity on the lower surface of said cap member aligns with said upper surface of said spacer so as to define a flexing zone for said second blade.

14. A flexible blade cartridge comprising a platform member defining a guard member and a cap member, and a blade means disposed therein having a forward and rearward section, said rearward section of said blade means permanently fixed between said guard member and said cap member, said forward section of said blade means flexible about the longitudinal axis of said blade means to a less aggressive position in response to applied shaving forces, wherein:

said cap member comprises means for preventing said blade means from moving in the upward direction, and said blade means comprises a first and second blade, said forward portion of said first and second blades being flexible to a less aggressive position in response to applied shaving forces, said first and second blades being flexible about the longitudinal axis of the respective blade, said flexible blade cartridge further comprising a spacer affixed to both said first and second blades so as to maintain a predetermined distance between the rearward portion of said first and second blades; said spacer comprising means for limiting the movement of said second blade to a predetermined level; said spacer comprising means for preventing said first blade from moving in the upward direction.

15. A flexible blade cartridge according to claim 1, wherein said spacer comprises a surface which engages a shaving surface so as to control the exposure of said second blade relative to the shaving surface.

* * * * *